US009689086B2

(12) United States Patent
Ida

(10) Patent No.: US 9,689,086 B2
(45) Date of Patent: Jun. 27, 2017

(54) ELECTRODE FOR POLISHING HOLLOW TUBE, AND ELECTROLYTIC POLISHING METHOD USING SAME

(71) Applicant: MARUI GALVANIZING CO., LTD., Hyogo (JP)

(72) Inventor: Yoshiaki Ida, Hyogo (JP)

(73) Assignee: MARUI GALVANIZING CO., LTD., Hyogo (JP)

( * ) Notice: Subject to any disclaimer, the term of this patent is extended or adjusted under 35 U.S.C. 154(b) by 395 days.

(21) Appl. No.: 14/413,520

(22) PCT Filed: Jul. 8, 2013

(86) PCT No.: PCT/JP2013/068593
§ 371 (c)(1),
(2) Date: Jan. 8, 2015

(87) PCT Pub. No.: WO2014/010540
PCT Pub. Date: Jan. 16, 2014

(65) Prior Publication Data

US 2015/0159294 A1 Jun. 11, 2015

(30) Foreign Application Priority Data

Jul. 11, 2012 (JP) ..... 2012-155490

(51) Int. Cl.
*C25F 7/00* (2006.01)
*C25F 3/16* (2006.01)
*C25F 7/02* (2006.01)

(52) U.S. Cl.
CPC ..... *C25F 7/00* (2013.01); *C25F 3/16* (2013.01); *C25F 7/02* (2013.01)

(58) Field of Classification Search
CPC ..... C25F 3/16; C25F 7/00
See application file for complete search history.

(56) References Cited

U.S. PATENT DOCUMENTS 3,827,950 A 8/1974 Diepers et al.
6,217,726 B1 4/2001 Lorincz et al.
(Continued)

FOREIGN PATENT DOCUMENTS

EP 0 046 913 12/1984
JP 49-46227 12/1974
(Continued)

OTHER PUBLICATIONS

Extended European Search Report issued Jul. 20, 2015 in corresponding European Patent Application No. 13816291.2.
(Continued)

*Primary Examiner* — Nicholas A Smith
(74) *Attorney, Agent, or Firm* — Wenderoth, Lind & Ponack, L.L.P.

(57) ABSTRACT

A wing electrode is configured by disposing at least a wing in a circumferential direction at equal intervals, the wing having a specific width in an axial direction of the electrode shaft and a tip in a shape corresponding to an inner surface of the hollow tube. A housing tube is arranged concentrically to the electrode shaft and to house the wing electrode by winding the respective wings around the electrode shaft. A slit of the housing tube is arranged in the axial direction so as to correspond to each wing. A diameter adjustment unit is operable to expand and contract each wing in the radial direction by rotating the electrode shaft and the housing tube relatively after inserting each wing into the slit of the housing tube. As a matter of course, the electrolyte is filled in the hollow tube at any time before the electrolytic treatment.

5 Claims, 13 Drawing Sheets

(56) References Cited

U.S. PATENT DOCUMENTS

| | | | |
|---|---|---|---|
| 2001/0020584 | A1 | 9/2001 | Lorincz et al. |
| 2003/0098245 | A1 | 5/2003 | Lin et al. |
| 2004/0121708 | A1 | 6/2004 | Hu et al. |
| 2007/0034506 | A1 | 2/2007 | Hu et al. |

FOREIGN PATENT DOCUMENTS

| | | | | |
|---|---|---|---|---|
| JP | 51-71822 | | 6/1976 | |
| JP | 55-12116 | | 3/1980 | |
| JP | 57-114669 | | 7/1982 | |
| JP | 61-023799 | | 2/1986 | |
| JP | 62-91900 | | 4/1987 | |
| JP | 03-98990 | | 10/1991 | |
| JP | 11-350200 | | 12/1999 | |
| JP | 2007-276062 | | 10/2007 | |
| JP | 2011-086450 | | 4/2011 | |
| WO | 98/48968 | | 11/1998 | |
| WO | WO 2008117403 | A1 * | 10/2008 | ..... C25D 7/04 |

OTHER PUBLICATIONS

International Search Report issued Oct. 22, 2013 in International (PCT) Application No. PCT/JP2013/068593.

* cited by examiner

ELECTRODE FOR POLISHING HOLLOW TUBE, AND ELECTROLYTIC POLISHING METHOD USING SAME

TECHNICAL FIELD

The present invention relates to an electrode for electropolishing an inner surface of a hollow tube and an electropolishing method using the electrode.

BACKGROUND ART

A linear collider will be constructed as an apparatus for creating a state of Big Bang by the collision of positrons and electrons (International Linear Collider Project). The linear collider uses a hollow tube 100 made of niobium, which is provided with flanges 101*a* and 101*b* at both ends, and has a diameter changing periodically in an axial direction, as shown in FIG. 13. There are requirements to obtain a predetermined effect in this experiment, and one requirement is that the inner surface of the niobium hollow tube 100 is to be smooth.

The hollow tube 100, however, is subjected to an excessive pressure and heat at the formation, so that a texture of an inner surface becomes distorted non-uniformly. If this surface status is left alone, the electric properties and the magnetic properties become uneven, too, with the result that it is impossible to impart a predetermined speed to the electrons and the positrons. Therefore, methods for polishing the inner surface of the hollow tube in a predetermined thickness have been developed as a countermeasure against such problem.

As the polishing method for the niobium hollow tube, there are two kinds of polishing methods, namely, a method for polishing chemically (hereinafter referred to a "chemical polishing") and a method for polishing electrochemically (hereinafter referred to an "electrolytic polishing").

According to the chemical polishing disclosed in Japanese Unexamined Patent Application Publication No. 57-114669, a mixture of fluoric acid, sulfuric acid and water is used as a polishing liquid, and a niobium member is immersed in the mixture, whereby the entire surface is chemically polished to be smooth. As a polishing liquid for the same purpose, it is also well-known that a mixture of fluoric acid, phosphoric acid and nitric acid is used. In either of the above methods, the whole of the hollow tube is immersed in the polishing liquid, so that the operation becomes very simple. However, the outer surface of the hollow tube, which is not required to be polished, is polished concurrently, and it accelerates the unnecessary contamination, the aging, and the deterioration of the polishing liquid. Moreover, there is a problem that a polishing amount differs notably depending on an immersion direction of a polishing object.

Such incident is involved in an action of stirring the polishing liquid by a produced gas, and the produced gas sticks to the inner surface of the tube due to the shape of hollow tube and damages the polished appearance, which results in many drawbacks.

With respect to the electropolishing, there are following examples.

Japanese Examined Patent Application Publication No. 55-12116 discloses an intermittent electropolishing wherein, the niobium hollow tube is placed keeping both openings in horizontal, a lower half part of the niobium hollow tube is partially immersed in the polishing liquid composed of the fluoric acid, the sulfuric acid and the water. While maintaining the partial immersion, the partial electropolishing is performed by turning on the power for a short time. And after the electricity went off, the tube is rotated to dissolve and remove an oxide film. These steps are executed repeatedly.

In the above-mentioned method, the outer surface of the hollow tube not to be polished is polished at the same time that the inner surface is polished, as a result, the unnecessary dissolving loss of the hollow tube occurs and the polishing liquid is consumed unnecessarily and contaminated. Moreover, the polishing unevenness occurs due to the intermittent polishing, and the operation is very dangerous because of handling the fluoric acid that is high volatile and produces toxic gas, and the sulfuric acid that is a high pyrogenic substance.

The invention disclosed in Japanese Unexamined Patent Application Publication No. 61-23799 is configured to perform the continuous electrolysis in the state of the partial immersion by supplying the polishing liquid from nozzles connected with a liquid feed pipe while rotating the niobium hollow tube. In this configuration, the polishing time can be reduced and the unnecessary dissolution of the niobium member can be eliminated, and therefore, it is possible to suppress the unnecessary contamination and consumption of the polishing liquid.

However, since it is configured that the nozzles provided to the liquid feed pipe are opened in the polishing liquid and the polishing liquid is discharged into the stored polishing liquid, the difference between the flow rates of the polishing liquid appears in the state of the polishing, and the unevenness of the polished appearance occurs on the inner surface of the niobium hollow tube, which is a problem, too.

The invention disclosed in Japanese Unexamined Patent Application Publication No. 11-350200 is the basically same as Japanese Unexamined Patent Application Publication No. 61-23799, but the nozzles provided to the liquid feed pipe is configure to be opened toward an upper side of the polishing liquid, the side opposite to the side to be polished, so as not to flow the polishing liquid direct into the stored polishing liquid. According such configuration, the invention realizes the uniform polishing.

CITATION LIST

Patent Literature 1: Japanese Examined Patent Application Publication No. 55-12116

Patent Literature 2: Japanese Unexamined Patent Application Publication No. 61-23799

Patent Literature 3: Japanese Unexamined Patent Application Publication No. 11-350200

SUMMARY OF INVENTION

Technical Problem

In the above electropolishing methods, however, the liquid feed pipe, that is a cathode, is in a linear shape, and regarding the inner surface of the hollow tube that is an object to be polished, the diameter varies in the wave pattern form as described above. Therefore, distances between each part of the inner surface of the hollow tube and the cathode are not homogeneous. The current gathers at a part which has a short distance. When the part having a large distance is polished in a predetermined thickness, an enormous time is required for the polishing and the cost increases.

In addition, in the above electropolishing methods, the hollow tube is placed in a horizontal position and the polishing liquid is stored in the lower part of the tube, and then the polishing is performed. At this time, a cavity is left in a part above the polishing liquid, and gases generated from the polishing liquid, such as hydrogen fluoride, stays at this part temporarily. There is a possibility that, as the polishing progresses, the polished surface deteriorates owing to the generated gases.

In the technique disclosed in Japanese unexamined patent application publication No. 11-650200, the hollow tube is placed in vertical when it is set up and filled with the polishing liquid, and the tube is placed horizontally when the polishing is performed, and then the tube is placed in vertical again when the disposal liquid is discharged. The operation becomes complicated very much.

The present invention has an object to polish the inner surface of the hollow tube uniformly and suppress the deterioration owing to the gases, and provide with a polishing electrode for facilitating assembly and disassembly operations of apparatus and an electropolishing method using it.

Solution To Problem

In the present invention, the electrode for polishing the hollow tube, of which diameter varies every part, is configured as follows.

A wing electrode is configured by disposing one or plural wings in a circumferential direction, the wing having a specific width in an axial direction of the electrode shaft and a tip in a shape corresponding to an inner surface of the hollow tube. A housing tube is arranged concentrically to the electrode shaft and to house the wing electrode by winding the respective wings around the electrode shaft. One or plural slits of the housing tube is arranged in the axial direction so as to correspond to respective wings. A diameter adjustment unit is operable to expand and contract each wing in the radial direction by rotating the electrode shaft and the housing tube relatively after inserting each wing into the slit of the housing tube. As a matter of course, the electrolyte is filled in the hollow tube at any time before the electrolytic treatment.

The electrode for polishing the hollow tube as configured as above is inserted into the hollow tube in a state of hosing a wing electrode in a housing tube, at an initial state. Next, the wing is expanded from the housing tube by rotating the electrode shaft against the housing tube, so as to make a distance between a tip of the wing and the inner circumference surface of the hollow tube suitable for the electropolishing. And, the voltage/current of the polarity corresponding to the polishing is applied between the hollow tube and the wing electrode. This makes the distance between the hollow tube and the electrode even at any part of the hollow tube, and it is possible to perform the uniform polishing on all the inner surface of the hollow tube in a short time.

In addition, after the polishing is finished, each wing of the wing electrode can be housed in the housing tube by rotating the electrode shaft against the housing tube in the reverse direction, and extracted from the hollow tube to be polished.

Advantageous Effect of Invention

According to the present invention, the distance between the hollow tube ad the electrode becomes uniform at any part of the hollow tube, and it is possible to perform the uniform polishing on all the inner surfaces of the hollow tube in a short time. Therefore, the internal texture of the hollow tube becomes uniform, and it is possible to realize the acceleration with high quality when the hollow tube is used as the accelerator for positrons and electrons. The present invention can be applied to the polishing for the hollow tube having uneven inner surfaces, and the application of the hollow tube is not limited to the accelerator. In addition, the present invention can be applied not only to the electrolytic polishing but also to the electrolytic plating, as a matter of course.

DESCRIPTION OF EMBODIMENTS

Figure 1:
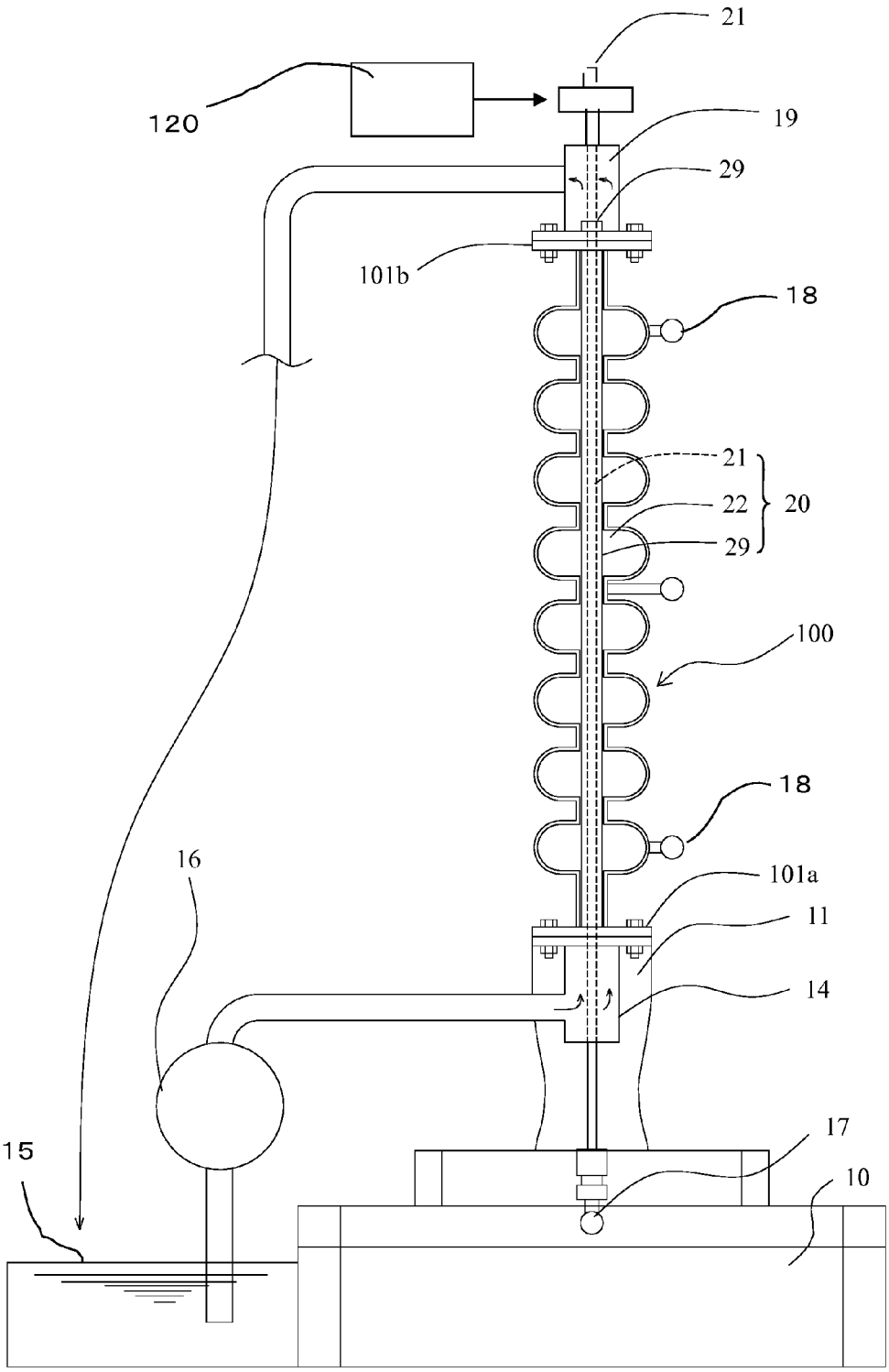
FIG. 1 is a side view indicating a state of using the electrode in the present invention.

FIG. 1 is a view indicating a state that the electropolishing is performed on a hollow tube using an electrode in accordance with the present invention. FIG. 2 to FIG. 5 are basically schematic views indicating one section (corresponding to a bulge of the hollow tube) of the electrode that the invention employs. First, the section of the electrode is explained hereinafter.

Figure 2:
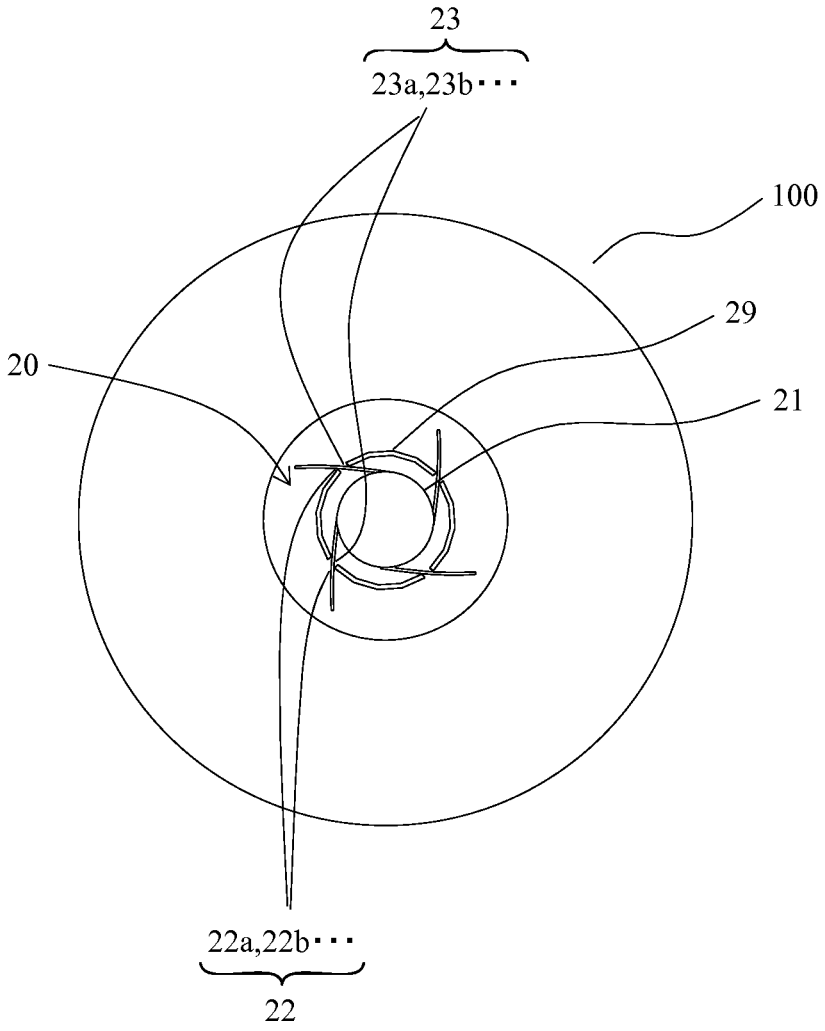
FIG. 2 is a plan view indicating a state before use of a section of the electrode in the present invention.
Figure 3:
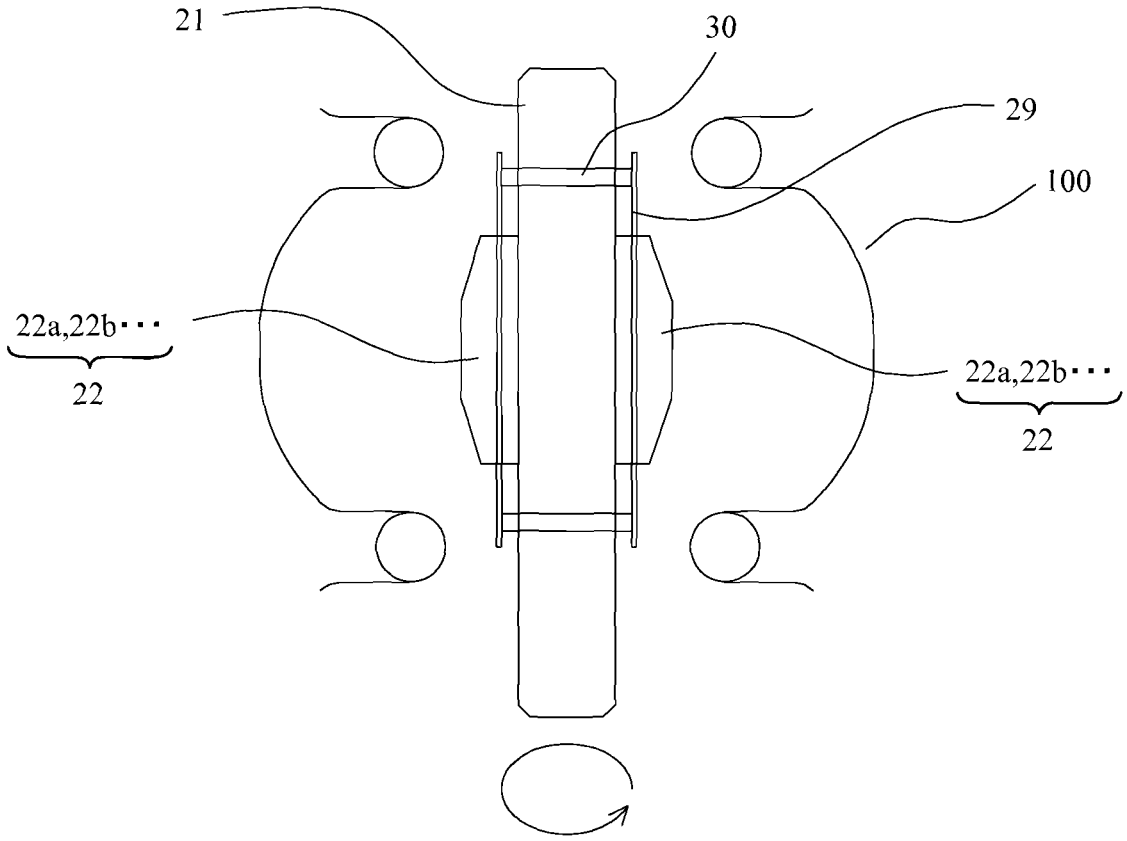
FIG. 3 is a side view of FIG. 2.
Figure 4:
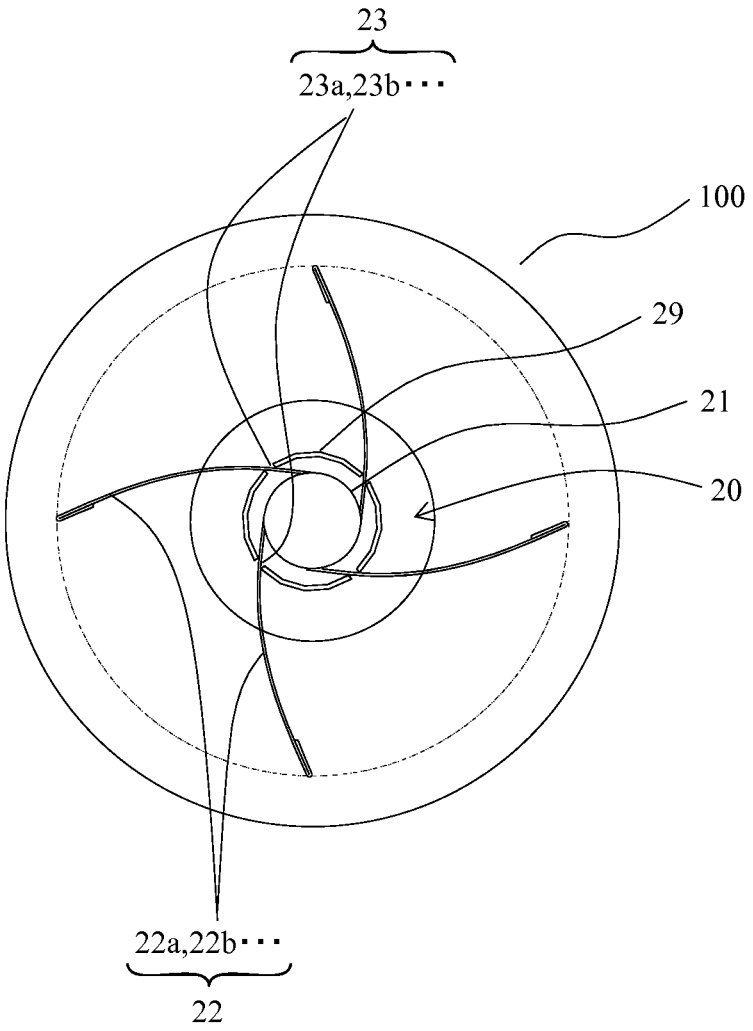
FIG. 4 is a plan view indicating a use state of the section of the electrode in the present invention.
Figure 5:
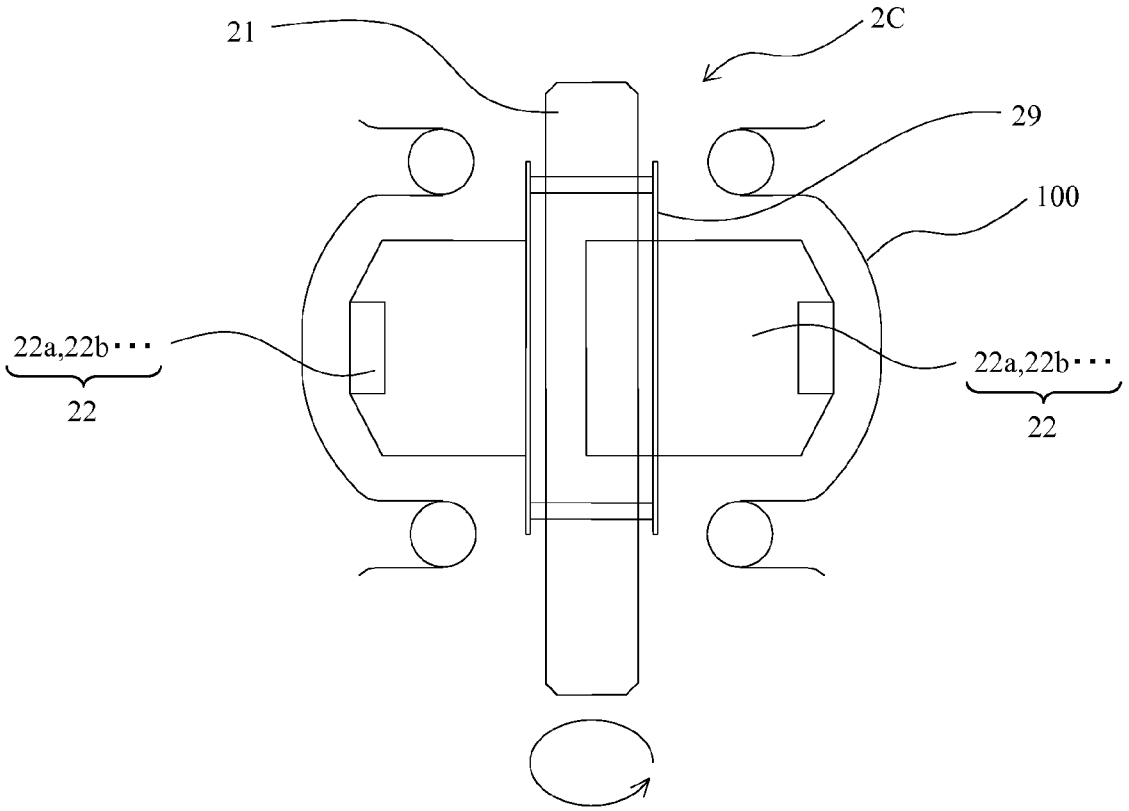
FIG. 5 is a side view of FIG. 4.

FIG. 2 is a plan view indicating the state before use of the electrode installed in the hollow tube, and FIG. 3 is a sectional view of the state. FIG. 4 is a plan view indicating the use state of the electrode installed in the hollow tube, and FIG. 5 is a sectional view of the state.

A wing electrode 22 is formed on an electrode shaft 21 by arranging at least one or plural wings 22*a*, 22*b* . . . in a circumferential direction of the electrode shaft 21 at equal intervals, the wing is made of a thin plate of which a base has a specific width in an axial direction, and an outer edge of the wing has a shape corresponding to an internal shape of the bulge of the hollow tube 100 to be polished, and at least the outer edge is made of a metal.

Each wing 22*a*, 22*b* . . . constituting the wing electrode 22 has flexibility. When each wing is wound around the electrode shaft, the diameter of the wing electrode becomes a minimum. In such state, the wing electrode is configured to be housed in a housing tube 29 formed concentrically to the electrode shaft. A slit group 23 (23*a*, 23*b* . . . ) is provided at a position corresponding to a tip of each wing 22*a*, 22*b* . . . in the state of storing the wings in the housing tube 29. It is configured that each wing 22*a*, 22*b* . . . is inserted in each slit 23*a*, 23*b* . . . constituting the slit group so as to slightly project the tip of the wing to an outside of the housing tube 29. Hereby, when rotating the electrode shaft and the housing tube relatively, the tip of each wing 22*a*, 22*b* . . . can be inserted and extracted in the radial direction. The diameter of the tip of each wing 22*a*, 22*b* . . . is configured to be adjusted (a diameter adjusting unit: the electrode shaft 21+the wing electrode 22+the housing tube 29+the slit group 23).

Besides, for instance, as the structure that the housing tube 29 is arranged concentrically to the electrode shaft, it is considered that a spacer 30, of which diameter is larger than the electrode shaft 21 and matches the diameter of the housing tube 29, is put around the electrode shaft 21.

As described above, there are two states of the wing electrode 22, namely, a housing state and a working state. Specifically, the housing state is the state that the tip of each wing 22*a*, 22*b* . . . is slightly projected from each slit 23*a*, 23*b* . . . of the housing tube 29 as shown in FIG. 2 and FIG. 3, and the working state is the state that the outer edge of each wing 22*a*, 22*b* . . . is pushed out near to an internal peripheral surface of the hollow tube 100 by relatively rotating the electrode shaft 21 and the housing tube 29 (a distance between the outer edge of each wing 22*a*, 22*b* . . . and the internal peripheral surface of the hollow tube 100 is approximately 1 cm, for example).

Figure 6:
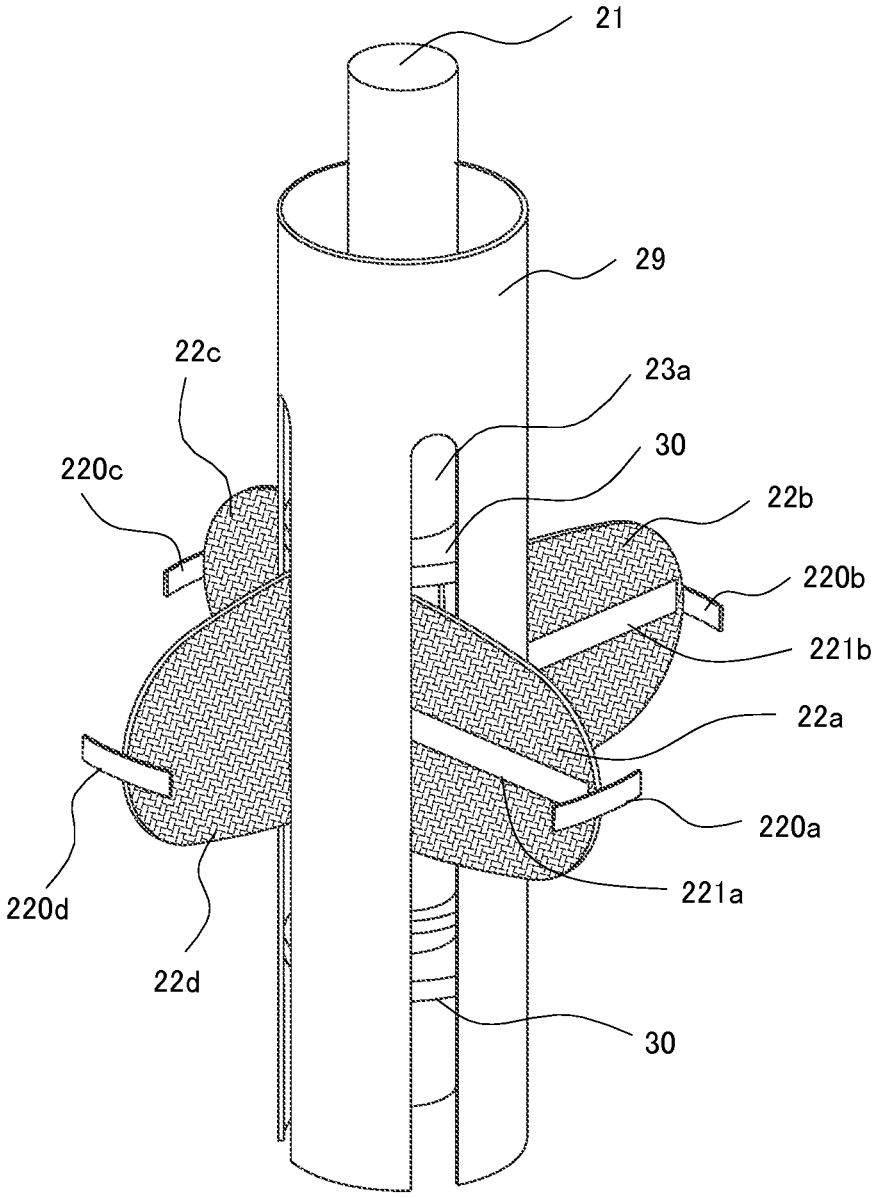
FIG. 6 is a perspective view indicating the other embodiment of the electrode in the present invention.
Figure 7:
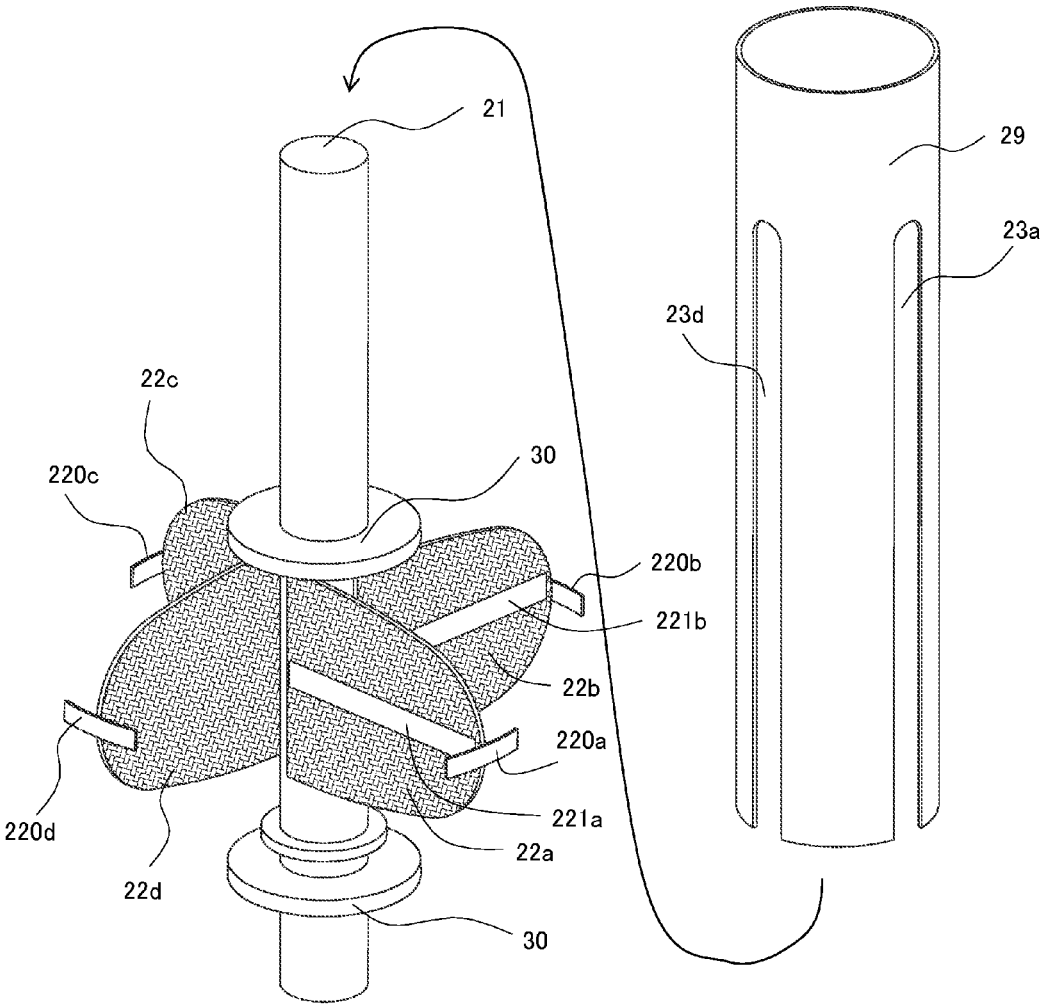
FIG. 7 is an exploded perspective view of FIG. 6.

FIG. 6 is the perspective view indicating a more specific embodiment of the wing electrode 22 in FIG. 2 to FIG. 5. FIG. 7 is the exploded perspective view of the wing electrode 22 in FIG. 6.

As described above, the wing electrode 22 is formed around the electrode shaft 21 by arranging at least one wing 22*a*, 22*b* . . . , in the shape corresponding to the bulge of the hollow tube, in a circumferential direction of the electrode shaft 21. Each wing 22*a*, 22*b* . . . constituting the wing electrode 22 is made of a mesh in metal (e.g. aluminum or copper). A shape retaining member 221*a*, 221*b* . . . , thin member made of metal or resin to impart with the flexibility thereto, is mounted on each wing 22*a*, 22*b* . . . from the base of each wing 22*a*, 22*b* . . . (the side of the electrode shaft 21) to the tip (the radial direction), by welding or depositing.

Figure 10:
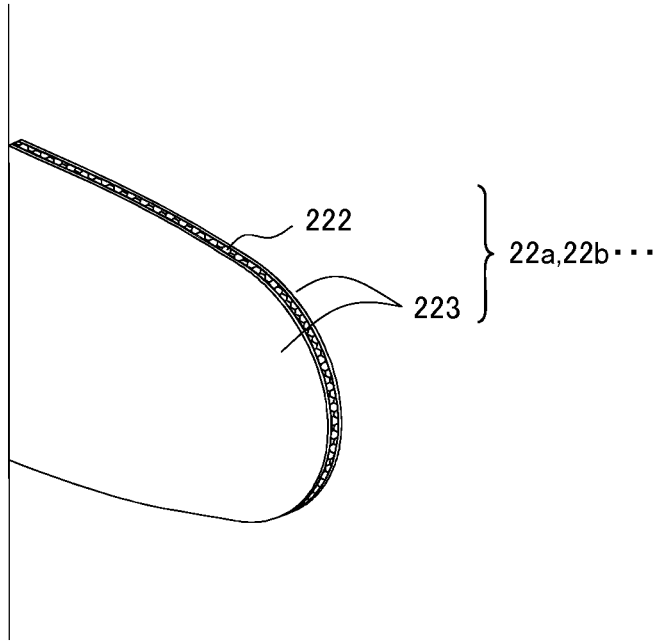
FIG. 10 is a perspective view indicating the other embodiment of the electrode having the other wing.

Otherwise, it may be configured, as shown in FIG. 10, that a front and back surfaces 223 of the metal mesh excluding an edge 222 are impregnated with synthetic resin, so as to impart the flexibility to each wing and ensure the electric insulation of the mesh surface and the electric conductivity of the edge.

In the state that each wing 22*a*, 22*b* . . . is attached to the electrode shaft 21, the spacer 30 of which diameter is larger than the electrode shaft 21 is fixed at a top and bottom positions of the wing electrode 22 of the electrode shaft 21.

While the wing electrode 22 is configured as above, the housing tube 29 is configured so that the diameter of the housing tube 29 matches the spacer 30, and the slits 23*a*, 23*b* open toward the bottom.

The housing tube 29 configured as above is put around the electrode shaft 21 through the spacer 30. At this time, it is configured so as to insert each wing 22*a*, 22*b* . . . in each slit 23*a*, 23*b* . . . Hereby, the electrode 20 (the electrode shaft+the wing electrode+the housing tube) is formed.

The steps of the electropolishing the inner surface of the hollow tube, in the state that the electrode 20 configured as above is installed in the hollow tube 100, is explained hereinafter.

The initial state of the electrode 20 is the housing state, and the electrode in this state is inserted in the hollow tube 100. Next, the electrode 20 is allowed to be the working state by rotating only the electrode shaft 21 while holding the housing tube 29 by hand in order not to rotate the housing tube 29, and expanding each wing 22*a*, 22*b* . . . in the radial direction till the distance between the inner surface of the hollow tube 100 and the outer edge becomes a suitable distance (e.g. 1 cm) for the electropolishing. In addition, the inside of the hollow tube is filled with electrolyte, and the electric field necessary for the polishing is applied between the wing electrode 22 and the hollow tube 100, and the electrode 20 is rotated by a driving unit 120 (at this time, rotating with the housing tube 29), whereby the inner surface of the hollow tube 100 is electropolished. After the electropolishing is terminated, the electrode is turned to the housing state by rotating only the electrode shaft 21 in the direction opposite to the rotational direction at forming the working state while holding the housing tube 29 by hand in order not to rotate, and then it is extracted from the hollow tube 100.

Besides, the slits 23*a*, 23*b* . . . of the housing tube 29 and each wing 22*a*, 22*b* . . . are usually configured so as not to slip on each other owing to the frictional force, but a force more than the frictional force is required to change from the working state to the housing state (or the reverse). When the electrode shaft 21 rotates for the electropolishing, the electrode shaft 21 and the housing tube 29 rotate together by the frictional force.

In the configuration shown in FIG. 6 and FIG. 7, supplemental electrodes 220*a*, 220*b* . . . , which have a predetermined width and a predetermined length in the circumferential direction, are arranged on the tip of the wing 22*a*, 22*b* . . . When each wing 22*a*, 22*b* . . . is expanded, the supplemental electrodes 220*a*, 220*b* . . . become a state along the circumferential shape near to the tip of the bulge of the inner circumference surface of the hollow tube 100 to be polished. As a matter of course, the supplemental electrodes 220*a*, 220*b* . . . can be attached to the wing shown in FIG. 10.

Where the tip of the wing is provided with the supplemental electrodes 220*a*, 220*b* . . . , when each wing 22*a*, 22*b* . . . is expanded at the electropolishing, it is possible to flow the current sufficiently to the innermost part of the bulge of the hollow tube 100, to which the current is generally hard to flow, through the supplemental electrode 220*a*, 220*b* . . . Since the length of the supplemental electrodes 220*a*, 220*b* . . . is longer than the gap of the slit 23*a*, 23*b* . . . , the supplemental electrodes serve as a stopper when each wing 22*a*, 22*b* . . . is wounded and housed in the housing tube 29, and the tip of each wing 22*a*, 22*b* . . . does not get into the internal part behind the slit 23*a*, 23*b* . . . , the next operation becomes easy.

Figure 8:
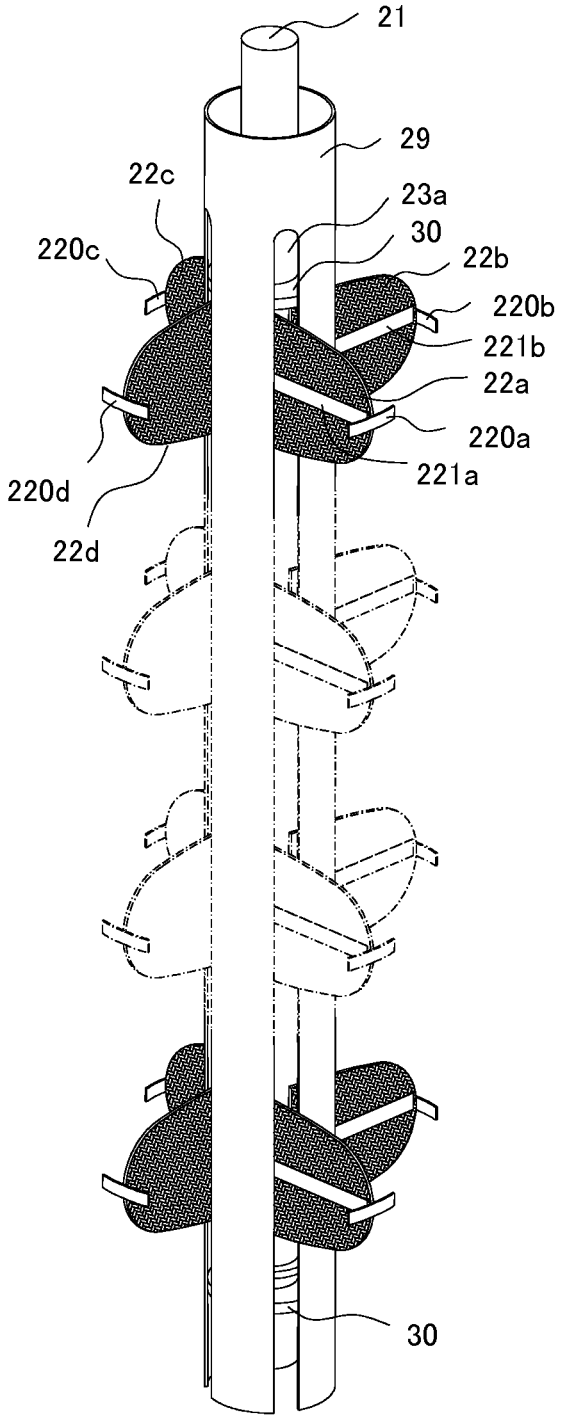
FIG. 8 is a perspective view indicating the embodiment when the electrode in the present invention has a plurality of wings.
Figure 9:
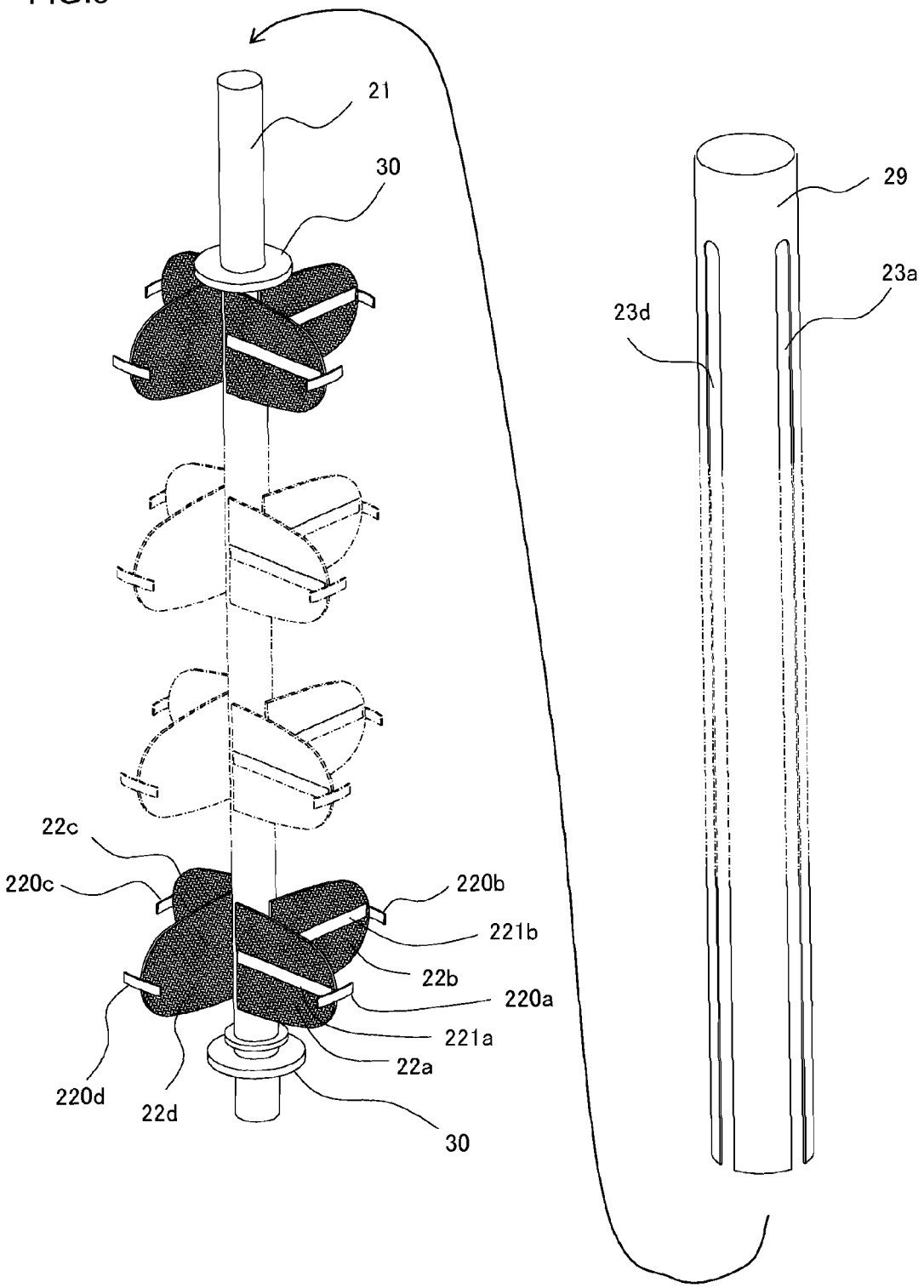
FIG. 9 is an exploded perspective view of FIG. 8.
Figure 13:
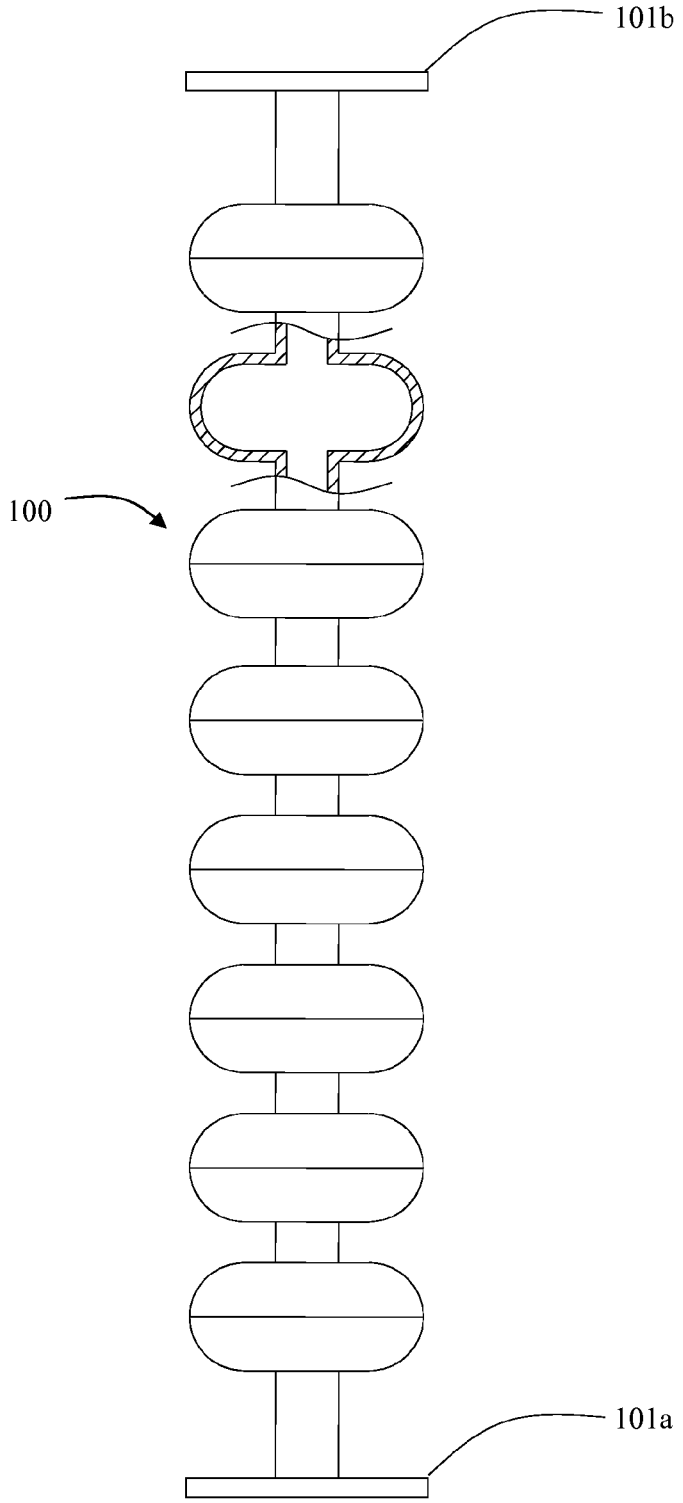
FIG. 13 is an elevation view of the hollow tube.

The section of the electrode 20 is formed as above, but the number of bulges of the inner circumference surface of the hollow tube is not one, there are plural in the axial direction periodically as shown in FIG. 13. Accordingly, the actual electrode 20 is arranged as shown in FIG. 8 and FIG. 9 so that the length of the electrode shaft 21 corresponds to the length of the axis of the hollow tube and the number of the wing electrodes 22 corresponds to the number of the bulges of the inner circumference surface of the hollow tube 100. In addition, the housing tube 29 is the approximately same length as the electrode shaft 21, and provided with a set of slit group 23 (23*a*, 23*b* . . . ) that is common to the plurality of wings in the axial direction.

FIG. 1 is the side view indicating the apparatus for polishing the inner surface of the hollow tube using the electrode configured as above.

A stand 11 is placed on a base 10, a liquid entrance room 14 is provided under a center of the stand 11. The polishing liquid is supplied from a polishing liquid tank 15 to the liquid entrance room 14 through a pump 16, and the polishing liquid is introduced to the internal part of the hollow tube 100 placed on the stand 11 through the liquid entrance room 14.

The hollow tube 100, which is an object to be polished, is fixed on the stand 11 by a flange 101*a*. Under such condition, the electrode 20 in the housing state is inserted therein from an upper end of the hollow tube. At this time, the electrode shaft 21 of the electrode 20 rotatably and liquid-tightly goes through the hollow tube to a part under the liquid entrance room 14, of which the bottom end is provided with a connector 17 to connect with a lead. Besides, since the hollow tube is long in vertical, a support frame 18 for fixing the hollow tube is supported by a prop not shown in figure in order to stabilize the tube on the stand 11.

While keeping the above state, the operator holds the housing tube 29 by hand and rotates the electrode shaft 21 to expand the diameter of each wing 22*a*, 22*b* . . . , and the working state is formed. Next, a liquid exit room 19 is fixed on the other flange 101*b* of the hollow tube 100. At this time, the electrode 21 is projecting rotatably and liquid-tightly above the upper end of the liquid exit room 19.

Since there is other variations than the above-mentioned structure regarding the setting structure of the hollow tube 100 and the installation structure of the electrode 20, the further explanation is omitted here, but the above-mentioned inserted electrode 20 (the electrode shaft 21, the wing electrode 22, the housing tube 29) is configured so as to rotate against the hollow tube when the rotational force is given to the electrode shaft 21. When the electrode shaft 21 rotates, each wing 22*a*, 22*b* . . . rotates in the hollow tube. In addition, the rotational force may be given by the driving unit 120.

Under such structure, the polishing liquid is introduced at a specific flow rate from the liquid entrance room_14 by the liquid supply pomp 16, and filled with the hollow tube, and discharged from the liquid exit room 17. And the electric filed necessary for the electropolishing is applied between the electrode shaft 21 and the hollow tube 100, and the electrode shaft 21 rotates slowly, whereby the inner surface of the hollow tube 100 can be polished. Since the various conditions with respect to the flow rate of the electrolyte and the intensity of the electric field are not the subject matter of the present invention, the detailed explanation is omitted here.

When the polishing is finished as described above, the polishing liquid is discharged (from a drain (not shown) provided to the liquid entrance room 14), and washing water is supplied from the liquid supply pomp 16 to the hollow tube, and the hollow tube is washed. After that, the electrode 20 is put into the housing state and then extracted from the hollow tube, whereby the operation is completed.

Figure 11:
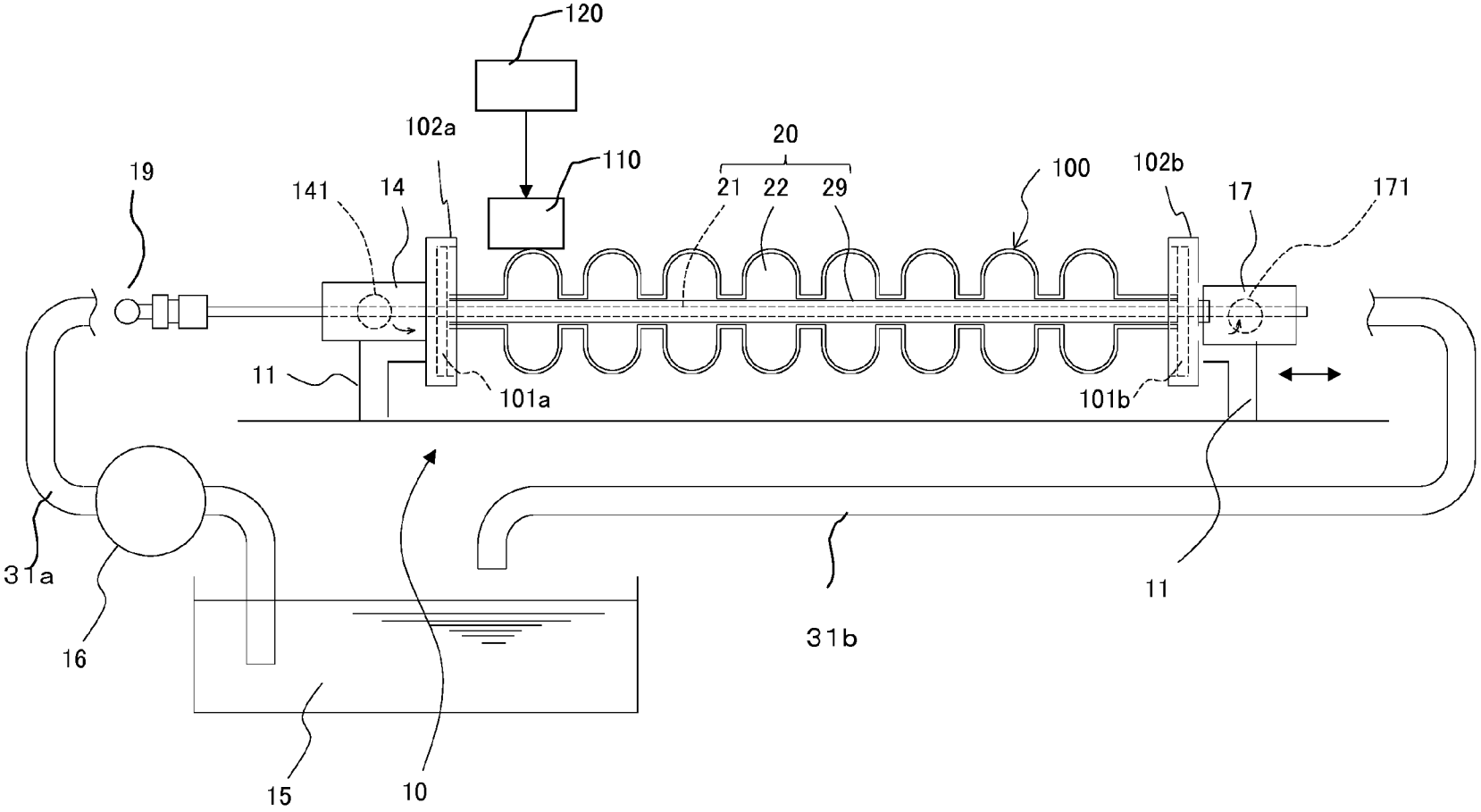
FIG. 11 is a view indicating a use state of the electrode in the present invention placed in horizontal.

FIG. 11 is a view indicating a case where the electrode in the present invention is horizontally placed for use.

In order to hold rotatably and liquid-tightly the flanges 101*a*, 101*b* . . . of the hollow tube 100, rotational hollow holders 102*a*, 102*b* . . . are provided to the stand 11 on the base 10. There are various structures for holding rotatably and liquid-tightly the flanges 101*a*, 102*b*, but it is not the subject matter here, so the detailed explanation is omitted. However, it is configured that one of the rotational hollow holders (102*a*, for example) is fixed on the base 10, and the other rotational hollow holder (102*b*, for example) is arranged movably and horizontally in the axial direction of the hollow tube 100 on the base 10. And the hollow tube 100 is configured as explained hereinafter to be fixed in the state of sandwiching the hollow tube between the rotational hollow holders 102*a* and 102*b*.

The liquid entrance room 14 is fixed on the outside of the rotational hollow holder 102*a* (the opposite side of the rotational hollow holder 102*b*), and an inlet 141 is provided to the liquid entrance room 14 at a position corresponding to the axis of the hollow tube 100. The electrolyte is configured to be supplied from the liquid supply pump 16 to the inlet 141 through a pipe 31*a*, whereby the electrolyte can be supplied to the liquid entrance room 14. In addition, the liquid exit room 17 is fixed on the outside of the other rotational hollow holder 102*b*, and an exit 171 is provided to the liquid exit room 17 at a position corresponding to the axis of the hollow tube 100, and the electrolyte can be discharged to a tank 15 through a pipe 31*b*.

Figure 12B:
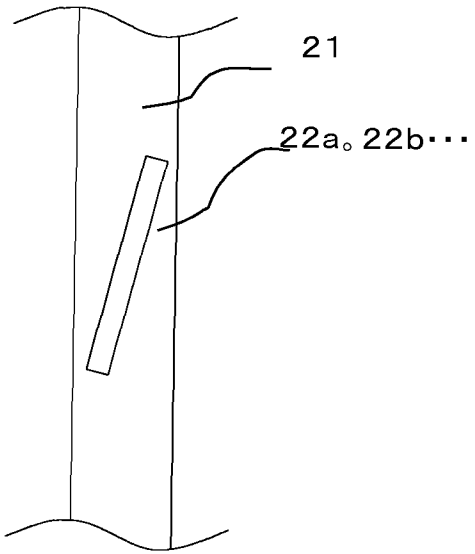
FIG. 12A and FIG. 12B indicate an example of the wing of the electrode having a screw effect.
Figure 12A:
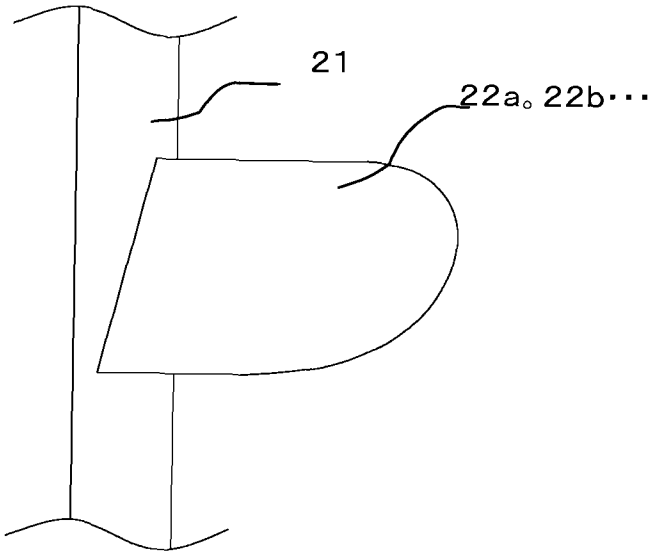

Each wing 22*a*, 22*b* . . . of the wing electrode 20 is slightly inclined with respect to the axial direction of the electrode shaft 21, or screwed at the tip as shown in FIG. 12 (FIG. 12A is a plan view, FIG. 12B is a side view of FIG. 12A), whereby the screw function is given to the wing electrode. At this time, the wing electrode is configured so as not to spoil the transform function from the housing state to the working state (or the reverse).

Here is explained about the electropolishing by means of the electropolishing apparatus and the wing electrode configured as above. First, the flange 101*a* of the hollow tube 100 is fixed rotatably and liquid-tightly on the rotational hollow holder 102 (in the state that the communication between the liquid entrance room and the hollow tube 100 is ensured). Next, the electrode 20 in the housing state is inserted from other end of the hollow tube 100 to the hollow tube. At this time, the electrode shaft 1 goes into the liquid entrance room 14 rotatably and liquid-tightly, of which the tip is connected with a lead connector 19. Under this state, the electrode shaft 21 is rotated while holding the housing tube 29 by hand in the same manner as the vertical use of the apparatus, whereby the working state of the electrode is formed. After that, the other rotational hollow holder 102*b* is moved and held by the other flange 101*b*, so that the position of the hollow tube 100 can be fixed rotatably and liquid-tightly (in the state that the communication between the liquid lead exit 17 and the hollow tube 100 is ensured).

While the hollow tube 100 is retained in both the rotational hollow holders 102*a* and 102*b* as mentioned above, a conductive rubber roller 110 abuts on the outside of the hollow tube 100 and the hollow tube 100 is rotated by the driving of the driving roller 120.

Under such configuration, the electrolyte is filled near to the position of the axis of the hollow tube 100 by operating the liquid supply pump 16, and the hollow tube 100 is rotated slowly by the driving unit 120 while the electric field necessary for the polishing is applied between the electrode shaft 21 and the hollow tube 100, whereby the electropolishing progresses. At this time, owing to the screw effect of the wing 22*a*, 22*b* . . . that is inclined as above, the electrolyte is pushed out toward a liquid exit room 17 as the hollow tube rotates. As a matter of course, the wing electrode 20 may be rotated actively in order to improve the push-out effect of the electrolyte at this time. Besides, the electric field is applied on the hollow tube 100 via the conductive rubber roller 110.

When the electropolishing is finished, the electrolyte is to be discharged. In order to discharge the electrolyte, it desired that the hollow tube 100 only or with the base 10 is placed vertically and the electrolyte is discharged. And then the wing electrode 20 is extracted after the wing electrode is changed to the housing state, and the polishing operation is finished.

The above description relates to the case where the electrode 22 has the plurality of wings, but the number of the wings may be at least one.

As a matter of course, the present invention employs the conventional electrolyte as the polishing liquid (for example, the liquid composed of fluoric acid, sulfuric acid and water). Additionally, the thickness to be polished is 50 μm to 100 μm where the hollow tube is the high-speed accelerator. The voltage to be applied at the polishing is around 15V, and the flowing current is approximately 20 $A/dm^2$.

The electrode applied to the present invention can be used not only at the electropolishing of the niobium hollow tube but also at the electropolishing for the inner surface of various kinds of metal tube, and it can be also used for the electrolytic plating.

INDUSTRIAL APPLICABILITY

As explained above, the present invention can electropolish the inner surface of the hollow tube in a very short time, even if the diameter of the hollow tube varies every part, since the electrode is configured so as to expand the wing electrode having the wings matching the diameter of the hollow tube. The present invention can be applied to the high-speed accelerator mainly, and any products requiring higher accuracy. In addition, as a matter of course, the electrode in the present invention can be applied to the electropolishing and the electrolytic plating. From such aspect, it is possible to expect the precise finishing of the product by the present invention, and the industrial applicability is very high.

REFERENCE SINGS LIST

10 Base
11 Stand
14 Liquid entrance room
17 Liquid exit room
20 Electrode
21 Electrode shaft
22 Wing electrode
22*a*, 22*b* . . . Wing
23 Slit group
23*a*, 23*b* . . . Slit
29 Housing tube
100 Hollow tube

The invention claimed is:

1. An electrode for polishing a hollow tube comprising:
an electrode shaft;
a wing electrode configured by disposing a wing or plural wings at equal intervals in a circumferential direction, the wing having a specific width in an axial direction of the electrode shaft and a tip in a shape corresponding to an inner surface of the hollow tube;
a housing tube arranged concentrically to the electrode shaft and housing the wing electrode winding the wings around the electrode shaft; and
a diameter adjustment unit operable to expand and contract each wing in the radial direction by rotating the electrode shaft and the housing tube relatively after inserting each wing to a slit of the housing tube in the axial direction corresponding to the each wing.

2. The electrode for polishing the hollow tube according to claim 1, wherein
the hollow tube has periodical bulge parts in the axial direction,
a shape of the wing electrode corresponds to the bulge part, and
the number of the wing electrodes corresponds to the number of the bulge parts.

3. The electrode for polishing the hollow tube according to claim 1, wherein the wing electrode is made of a metal mesh, and is imparted with the flexibility and the electric insulation by impregnating a front and back surfaces of the electrode except the tip with the synthetic resin.

4. An electropolishing method for a hollow tube comprising steps of:
inserting the electrode for polishing the hollow tube according to claim 1 into the hollow tube in a state that a wing electrode is housed in a housing tube;
expanding the wing from the housing tube till a distance between a tip of the wing and the inner circumference surface of the hollow tube becomes a suitable distance for the electropolishing by rotating the electrode shaft against the housing tube; and
applying voltage and current of the polarity corresponding to the polishing between the hollow tube and the wing electrode.

5. The electropolishing method for the hollow tube according to claim 4, further comprising steps of:
housing each wing of the wing electrode in the housing tube by rotating the electrode shaft against the housing tube in the reverse direction after the polishing is finished; and
extracting the wing electrode from the hollow tube to be polished.

* * * * *